US006273443B1

(12) United States Patent
Fleigle

(10) Patent No.: US 6,273,443 B1
(45) **Date of Patent: *Aug. 14, 2001**

(54) UNIVERSAL ELEVATING LEG REST ASSEMBLY

(75) Inventor: Donald E. Fleigle, Ventura, CA (US)

(73) Assignee: Sunrise Medical HHG Inc., Longmont, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,270

(22) Filed: Jun. 1, 1998

(51) Int. Cl.[7] ..... B02K 15/00

(52) U.S. Cl. ..... 280/304.1; 280/250.1; 297/423.1

(58) Field of Search ..... 280/304, 304.1, 280/250.1; 403/116, 113, 103, 88; 297/4, 71, 68, 423.22, 423, 423.24, 443.25, 423.26, 423.37

(56) References Cited

U.S. PATENT DOCUMENTS

| | | | | |
|---|---|---|---|---|
| 3,205,006 | * | 9/1965 | Mommsen | 297/423.37 |
| 3,301,595 | * | 1/1967 | Jennings | 297/423.37 |
| 3,376,067 | * | 4/1968 | Kernes | 297/423.37 |
| 3,453,027 | | 7/1969 | Pivacek . | |
| 3,482,873 | | 12/1969 | Pivacek . | |
| 3,672,722 | | 6/1972 | Murcott . | |
| 3,854,774 | | 12/1974 | Limpach . | |
| 3,857,606 | | 12/1974 | Rodaway . | |
| 3,883,175 | | 5/1975 | Rodaway . | |
| 4,026,164 | * | 5/1977 | Mozingo | 74/478 |
| 4,176,879 | * | 12/1979 | Rodaway | 297/423.37 |
| 4,722,572 | * | 2/1988 | Sata | 297/423.37 |
| 4,813,693 | | 3/1989 | Lockard et al. . | |
| 4,840,390 | | 6/1989 | Lockard et al. . | |
| 4,931,809 | * | 6/1990 | Putman et al. | 343/882 |
| 4,981,305 | * | 1/1991 | Lockard et al. | 280/250.1 |
| 4,988,114 | | 1/1991 | Thornton, Jr. et al. . | |
| 5,033,793 | | 7/1991 | Quintile . | |
| 5,209,509 | | 5/1993 | Gay et al. . | |
| 5,393,082 | | 2/1995 | Fenley . | |
| 5,401,045 | | 3/1995 | Foerster et al. . | |

FOREIGN PATENT DOCUMENTS

| | | |
|---|---|---|
| 2725493 | 12/1978 | (DE) . |
| G9308088.3 | 9/1993 | (DE) . |
| 2089204 | 6/1982 | (GB) . |

* cited by examiner

*Primary Examiner*—Lanna Mai
*Assistant Examiner*—Hua Phan
(74) *Attorney, Agent, or Firm*—MacMillan, Sobanski & Todd, LLC

(57) ABSTRACT

A universal elevating leg rest assembly for a wheelchair. The leg rest assembly includes an upper hanger plate mounted on a front tube member of the wheelchair. A lower hanger plate is mounted on the front tube member in a vertically-aligned, spaced-apart relationship with the upper hanger plate. A universal bracket assembly is pivotally mounted to the upper and lower hanger plates and allows the elevating leg rest assembly to be positioned on either the left or right side of the wheelchair. A latch mechanism allows the universal bracket assembly to be locked in place or unlocked, swung-away and detached from the wheelchair, if desired. A calf clamp assembly is hingedly connected to the universal bracket assembly. A release mechanism including an arcuate-shaped cam surface frictionally engages an arcuate-shaped cam surface of the calf clamp assembly to lock the leg rest assembly at a selected vertical position. Depressing the release knob causes the cam surfaces to no longer frictionally engage each other and unlocks the leg rest assembly from the selected vertical position.

11 Claims, 6 Drawing Sheets

UNIVERSAL ELEVATING LEG REST ASSEMBLY

BACKGROUND OF THE INVENTION

This invention relates in general to a wheelchair, and in particular, to an elevating leg rest assembly capable of being used on either side of the wheelchair.

Up until now, many of the prior art devices utilize rather complicated mechanisms for elevating the leg of the occupant. In addition, all existing wheelchair leg rests have a left and right leg rest for the respective side of the wheelchair. These "handed" leg rests have many parts unique to the left or right side of the wheelchair. Further, the attachment points and the hangers for the leg rest are also unique for the left or right side of the wheelchair. As a result, the wheelchair supplier or health care provider is required to manufacture, assemble, and stock parts that are unique to the left and right side of the wheelchair, thereby increasing the cost of manufacturing the wheelchair and creating an inventory problem for the wheelchair dealer or health care provider. Accordingly, it is desirable to provide an universal elevating leg rest assembly that can be used for either the left or right side of the wheelchair.

SUMMARY OF THE INVENTION

This invention relates to a universal elevating leg rest assembly for connecting to a wheelchair. The elevating leg rest assembly includes an upper hanger plate having at least one pivot pin being mounted on a front tubular member of the wheelchair. A lower hanger plate having at least one pivot pin is mounted on the front tubular member in a vertically-aligned, spaced-apart relationship with the upper support plate. A universal bracket assembly is pivotally mounted to the pivot pins of the upper and lower hanger plates using pivot holes. The universal bracket assembly allows the elevating leg rest assembly to be positioned on the either side of the wheelchair. A locking mechanism locks the elevating leg rest assembly in a forward position and allows the occupant to unlock and detach the elevating leg rest assembly, if desired. A calf clamp assembly includes an arcuate-shaped opening for hingedly connecting the calf clamp assembly to the universal bracket assembly. The calf clamp assembly includes an arcuate-shaped cam surface for allowing the occupant to position the elevating leg rest assembly at a desired height. A release mechanism includes a push knob, a release plate and a locking cam having an elliptical-shaped cam surface for frictionally engaging the arcuate-shaped cam surface of the calf clamp assembly. A calf support assembly includes a support plate for supporting the leg of the occupant.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
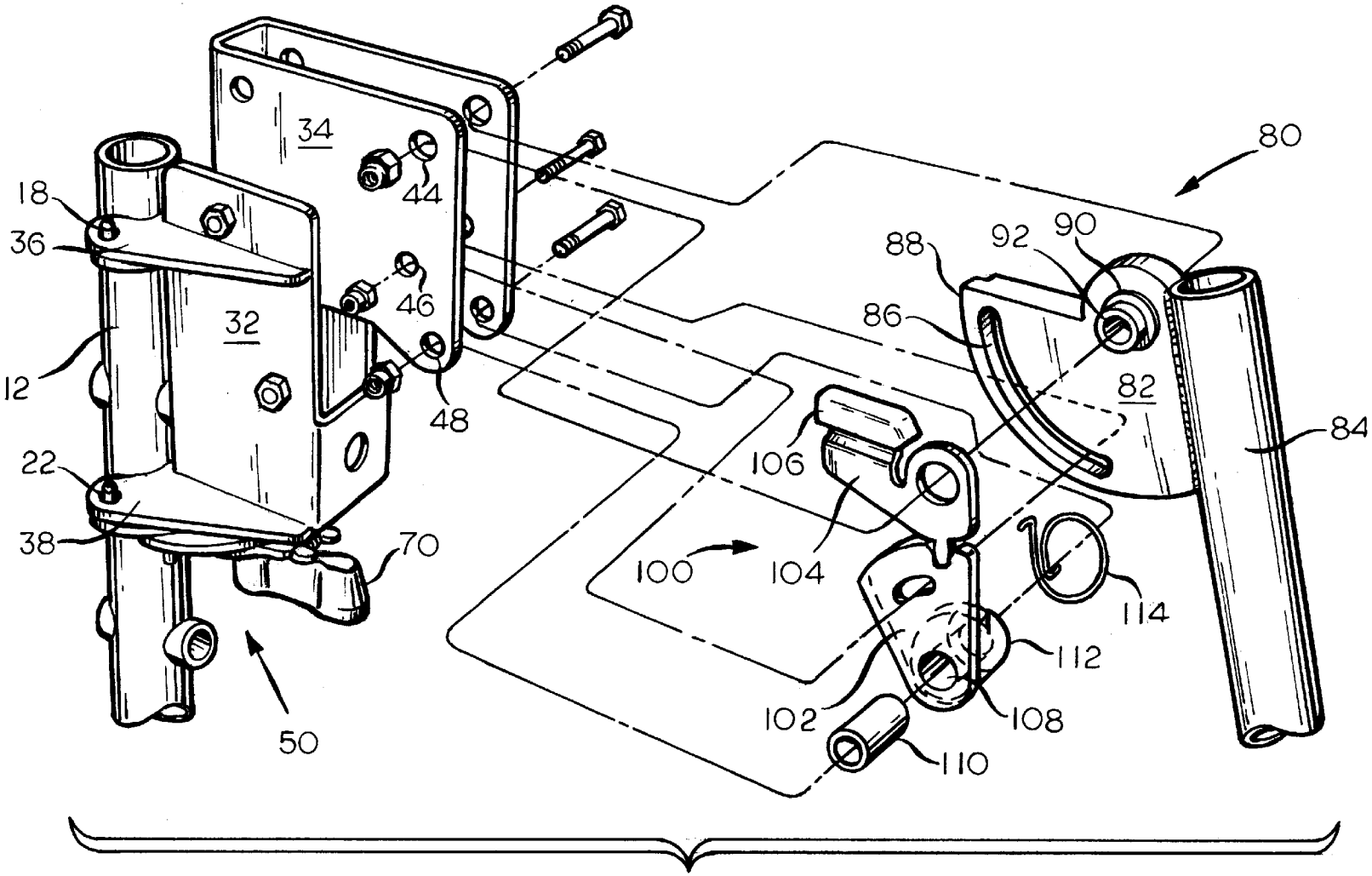
FIG. 1 is an exploded perspective view of the universal elevating leg rest assembly according to a preferred embodiment of the invention.
Figure 2:
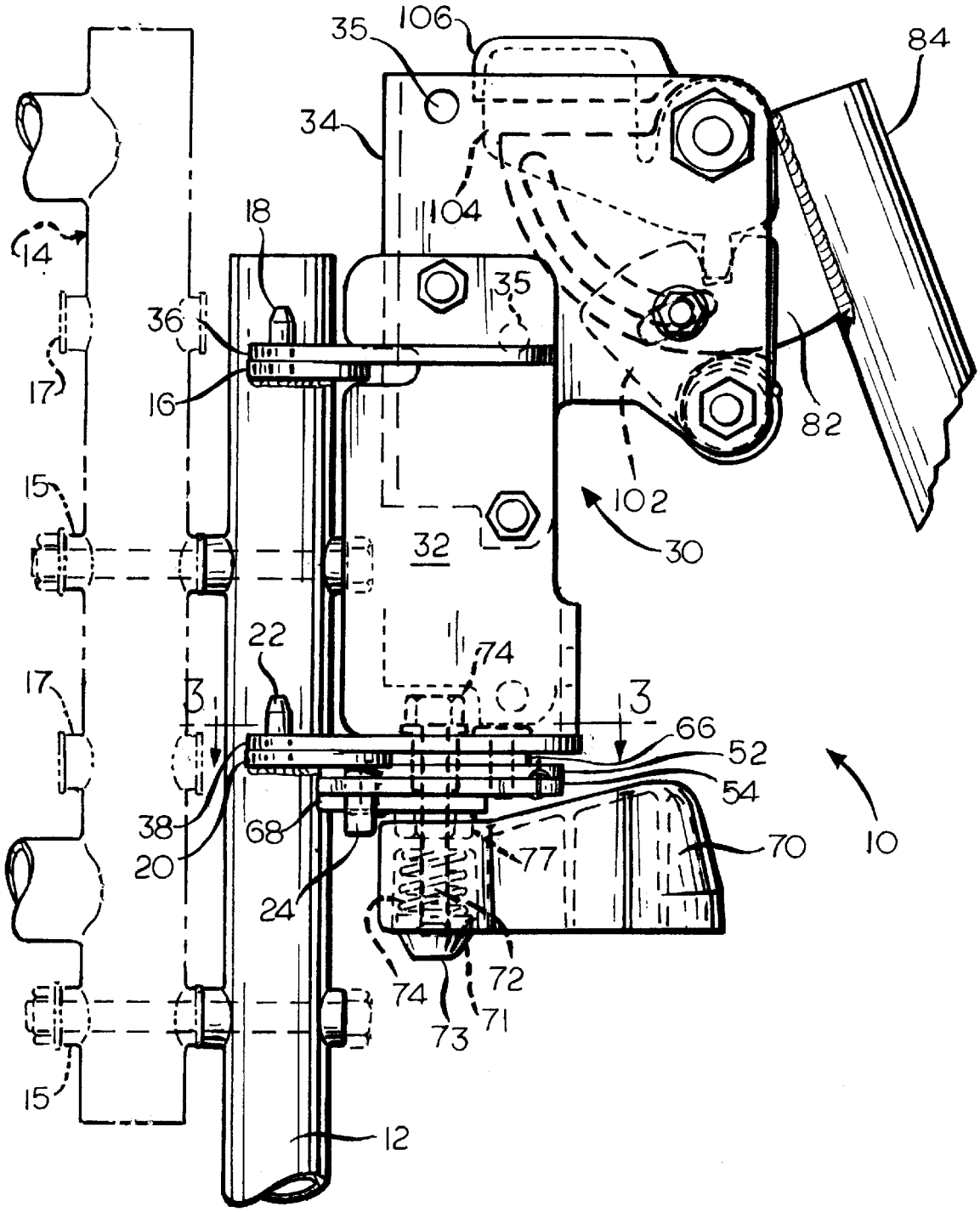
FIG. 2 is a side view of the universal elevating leg rest assembly mounted to a portion of a wheelchair according to the preferred embodiment of the invention.

Referring now to FIGS. 1–4, there is illustrated the universal elevating leg rest assembly 10 according to the preferred embodiment of the invention. The leg rest assembly 10 includes a hanger tube member 12 for attaching the footrest assembly 10 to the frame tube member 14 (shown in phantom) using conventional means, such as a threaded fastener, and the like. It should be noted that the hanger tube member 12 may be an integral portion of the wheelchair, if desired. As shown in FIG. 2, the hanger tube member 12 and frame tube member 14 each include a pair of equally-spaced apertures 15 for allowing the threaded fastener to pass therethrough. In addition, the frame tube member 14 includes a second pair of apertures 17. When the hanger tube member 12 is attached to the frame tube member 14 using the bottom set of apertures 15, as shown in FIG. 2, the hanger tube member 12 is attached to the frame tube member 14 such that the elevating leg rest assembly 10 is in a "standard" position. When the hanger tube member 12 is attached to the frame tube member 14 using the top set of apertures 17, the hanger tube member 12 is attached to frame tube member 14 such that the elevating leg rest assembly 10 is in a "hemi" position. The "hemi" position lowers the relative position of the frame tube member 14 with respect to the hanger tube member 12, and an occupant sitting the in wheelchair frame, such that the occupant may be able to propel the wheelchair with a capable foot, if desired. The "standard" position is used when both feet are to be elevated off the ground while the wheelchair is in motion.

The hanger tube member 12 includes an upper hanger plate 16 with an upwardly extending pivot pin 18. The hanger tube member 12 also includes a lower hanger plate 20 that is spaced apart from the upper hanger plate 16 by a predetermined distance. The lower hanger plate 20 includes an upwardly extending pivot pin 22 and a pair of downwardly extending latch pins 24, 25. Preferably, the upper and lower hanger plates 16, 20 and the pivot pins 18, 22 are in vertical alignment with each other. The upper and lower hanger plates 16, 20 may be integrally formed with the hanger tube member 12 or may be attached to the hanger tube member 12 using means well known in the art, such as welding, brazing, and the like. It should be noted that for the right side of the wheelchair with respect to an occupant sitting in the wheelchair, both the pivot pins 18, 22 are located on the right side of the hanger tube member 12, as shown in FIG. 1. In addition, it should be readily apparent that for the left side of the wheelchair, the pivot pins 18, 22 would be located on the left side of the hanger tube member 12.

The elevating leg rest assembly 10 includes a universal bracket assembly, generally shown as 30, for pivotally mounting the leg rest assembly 10 to either side of the wheelchair. The universal bracket assembly 30 includes a lower bracket 32 and an upper bracket 34. The lower bracket 32 includes an upper mounting plate 36 and a lower mounting plate 38. The upper and lower mounting plates 36, 38 may be integrally formed with the lower bracket 32 or may be attached to the lower bracket 32 using means well known in the art, such as welding, brazing, and the like. The upper and lower mounting plates 36, 38 are formed having respective pairs of apertures or pivot holes 40, 42 that are in substantial vertical alignment with each other and with the pivot pins 18, 22. Each of the pivot holes 40, 42 has a diameter sufficiently large such that the pivot pins 18, 22 can be received in the pivot holes 40, 42 to pivotally mount the universal bracket assembly 30 to the upper and lower hanger plates 16, 20 attached to the hanger tube member 12.

Preferably, the predetermined distance between the upper and lower mounting plates 36, 38 is approximately equal to the predetermined distance between the upper and lower hanger plates 16, 20 such that the upper and lower hanger plates 16, 20 can support the upper and lower mounting plates 36, 38 when the pivot pins 18, 22 are received in the pivot holes 40, 42. The lower mounting plate 36 also includes a stop pin 44 (shown in phantom in FIG. 3) extending downwardly a predetermined distance from the lower mounting plate 36.

Preferably, the upper bracket 34 is generally U-shaped having substantially parallel side walls that are separated a predetermined distance such that the upper bracket 34 can be disposed within the side walls of the lower bracket 32. In this manner, the upper bracket 34 can be fixedly attached to the lower bracket 32 using well-known means, such as threaded fasteners and the like. As shown in FIG. 2, the side wall of the lower bracket 32 and the side wall of the upper bracket 34 includes a pair of apertures for allowing the threaded fastener to pass therethrough. In addition, the side wall of the upper bracket 34 includes an upper pair of apertures 35. When the upper bracket 34 is attached to the lower bracket 32 using the upper pair of apertures 35, the upper bracket 34 is attached to lower bracket 32 such that the elevating leg rest assembly 10 is in the "hemi" position, rather than the "standard" position, as shown in FIG. 2. The "hemi" position lowers the relative position of the upper bracket 34 with respect to the lower bracket 32 to account for the lowering of the frame tube member 14 so that the pivot point for the occupant's knees and hips may be properly located when the wheelchair is in the "hemi" position. It should be noted that the side walls of the upper bracket 34 also includes a plurality of openings 44, 46, 48 for receiving threaded fasteners (FIG. 1).

Figure 3:
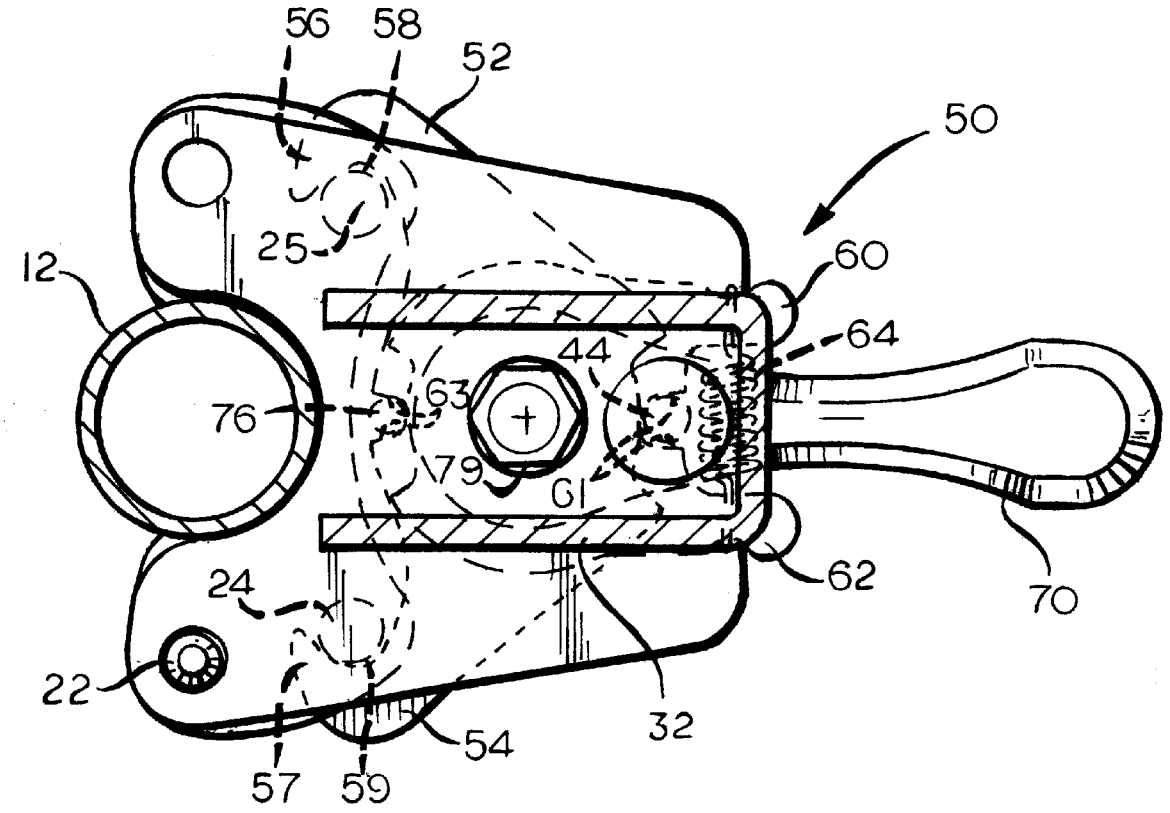
FIG. 3 is a cross-sectional view of the latch mechanism taken along lines 3—3 of FIG. 2.

As best seen in FIG. 3, the elevating leg rest assembly 10 also includes a latch mechanism, shown generally at 50, for locking the elevating leg rest assembly 10 in a predetermined position relative to the frame tube member 14 of the wheelchair. The latch mechanism 50 includes an upper latch member 52 and a lower latch member 54. The lower latch member 54 can be mirror symmetric to the upper latch member 52, that is, substantially identical to the upper latch member 52 when it is turned upside down. In this manner, inventory is reduced, and the cost of manufacture is reduced.

Each latch member 52, 54 includes a generally C-shaped latch portion 56, 57 forming a latch seat 58, 59 for engaging the downwardly-extending latch pins 24, 25 located on the lower hanger plate 20. A tab portion 60, 62 is located on the opposite side of each latch member 52, 54. A stop pin 44 is positioned between the latch members 52, 54. A spring 64 positioned between each tab portion 60, 62 may be used to bias the tab portions 60, 62 toward each other so that a second cam surface 61 on each member 52, 54 is urged against the stop pin 44. A spacer plate 66 is located between the lower mounting plate 38 and the upper latch member 52 to position the upper latch member 52 a predetermined distance from the lower mounting plate 38.

The latch mechanism 50 also includes a release plate 68, a release knob 70 and a release pin 72 for locking and unlocking the latch mechanism 50. Preferably, the release pin 72 is threaded at both ends and includes a seat member 78 (shown in phantom in FIG. 2), such as a hex-shaped nut, located approximately equidistant from both ends of the release pin 72. Alternatively, the release pin 72 may be a clevis pin (not shown) having a roll pin located adjacent the release plate 68 for relative movement therewith. It should be noted that the upper end of the release pin 72 has a flattened surface, thus producing an irregularly-shaped upper end. The release plate 68 includes an irregularly-shaped aperture 90 that is complementary to the irregularly-shaped upper end of the release pin 72, allowing the lower end of the release pin to pass therethrough. The release plate 68 includes a latch pin 76 of sufficient length for engaging a first cam surface 63 on each of the upper and lower latch members 52, 54. In addition, the upper end of the release pin 72 is of sufficient length to allow the upper end of the release pin 72 to pass through the release plate 68, the lower latch member 54, the upper latch member 52, and the lower mounting plate 38 such that a fastener 79, such as a lock nut, can be threaded onto the upper end of the release pin 72. An octagonal shaped nut 77 is attached to the release pin 72 below the release plate 68 to engage the release plate 68.

The release knob 70 preferably includes an opening 71 at one end thereof. The upper end of the opening 71 (shown in phantom) is complementary in shape to the octagon-shaped nut 77 such that the it can be seated in the opening 71 to operatively connect the release pin 72 to the release knob 70. It should be realized that turning the release knob 70 in one direction causes the release plate 68 to turn in the same direction. A spring 74 may be inserted into the opening 71 to exert a upward bias on the release knob 70. A fastener, such as a lock nut 73, may be threaded onto the release pin 72 to cause the spring 74 to exert the upward bias against the release knob 70 and to seat the nut 77 in the upper end of the release knob 70.

As shown in FIGS. 2 and 3, the release knob 70 is oriented such that the release knob 70 is pointing in a forward orientation. However, because the octagon-shaped nut 77 is received in the complimentary-shaped recess 71 of the release knob 70, the elevating leg rest assembly 10 has the ability to position the release knob 70 in eight different orientations as determined by the user. This can be accomplished by pulling the release knob 70 in a downward direction until the release knob 70 clears the octagon-shaped nut 77, rotating the release knob 70 to the desired orientation and then releasing the release knob 70 such that the bias of the spring 74 causes the nut 77 to again be received in the opening 71 of the release knob 70. It should be appreciated that the invention is not limited by the number of different orientations that the release knob 70 can be positioned by user, and that the invention can be practiced using any shape for the recess and any complimentary shape for the nut.

Because the release pin 72 operatively connects the release knob 70 to the release plate 68, turning the release knob 70 in one direction, for example in a clockwise direction as viewed in FIG. 3, causes the release plate 68 to turn in the same direction. As a result, the latch pin 72 on the release plate 68 also moves in the same clockwise direction. The engagement of the latch pin 72 with the cam surface of the lower latch member 54 causes the lower latch member 54 to pivot in the counterclockwise direction until the latch seat 59 of the lower latch member 54 no longer engages the latch pin 24 of the lower mounting plate 38. The stop pin 44 in mating contact with the cam surface of the lower latch member 54 prevents over-rotation of the lower latch member 54.

Figure 4:
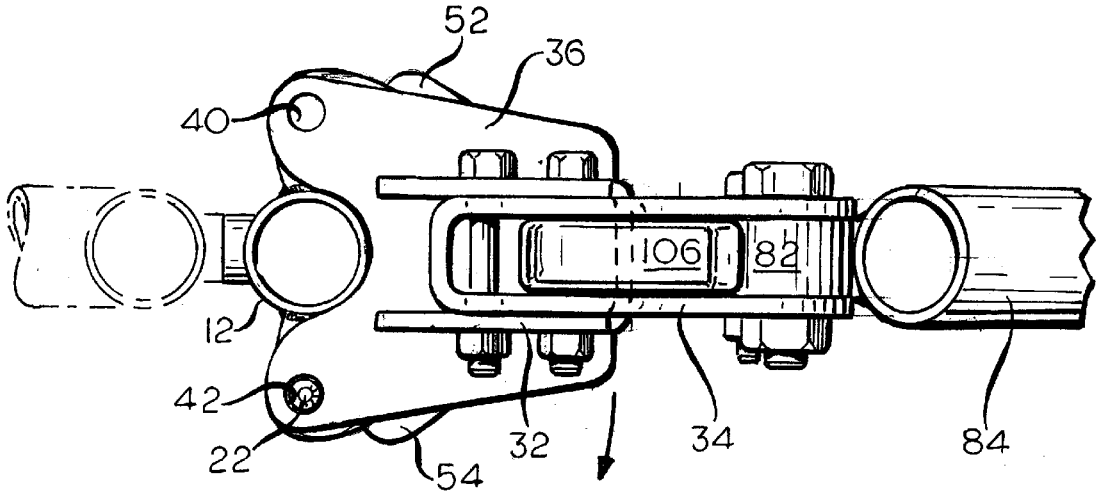
FIG. 4 is a top view of the universal elevating leg rest assembly.

At this point, the elevating leg rest assembly 10 can be pivoted away from the wheelchair, as indicated by the arrow in FIG. 4. After the release knob 70 is released, the bias of the spring 64 causes the lower latch member 54 to pivot in the clockwise direction and the release knob 70 to return to its original, neutral position. Subsequently, the elevating leg rest assembly 10 can be easily detached from the wheelchair by lifting upward on the elevating leg rest assembly 10 until the pivot pins 18, 22 are no longer received in the pivot holes 40, 42. The structure and operation of the universal bracket assembly 30 and the latch mechanism 50 are described in more detail in a commonly-assigned, co-pending application U.S. Serial No. 08/088,277 filed Jun. 1, 1998 herein incorporated by reference.

The elevating foot rest assembly 10 also includes a calf clamp assembly, generally indicated as 80. The calf clamp assembly includes a locking sector 82 fixedly attached to a top tube member 84. The locking sector 82 may be integrally formed with the top tube member 84 or may be attached to the top tube member 84 using means well known in the art, such as welding, brazing, and the like. The locking sector 82 includes an arcuate-shaped opening or slot 86, an arcuate-shaped cam surface 88 and an opening 90. A flanged bushing 92 may be disposed within the opening 90 to pivotally mount the calf clamp assembly 80 to the opening 44 of the upper bracket 34 using any suitable means, such as a threaded fastener, and the like. In addition, the arcuate-shaped opening 86 may be used to hingedly connect the calf clamp assembly 80 to the opening 46 of the upper bracket 34 using any suitable means, such as a threaded fastener, and the like.

The elevating leg rest assembly 10 further includes a release mechanism, generally shown as 100. The release mechanism 100 includes a locking cam 102, a release plate 104 and push knob 106. The locking cam 102 includes a substantially circular-shaped opening 108 for receiving a bushing 110 to pivotally mount the locking cam 102 to the opening 48 of the upper bracket 34 using a threaded fastener, and the like. The opening 108 also forms an outwardly extending, elliptical-shaped cylindrical cam surface 112 for engaging the arcuate-shaped cam surface 88 of the locking sector 82, as discussed below.

Referring now to FIG. 1, a spring 114 may be disposed around the cam surface 88 to bias the locking cam 102, for example, in a counterclockwise direction. When the top tube member 84 of the calf clamp assembly 80 is raised, the cam surface 88 of the locking sector 82 frictionally engage the cam surface 112 of the locking cam 102. As a result, the cam surface 88 rotates in a counterclockwise direction, whereas the cam surface 112 rotates in a clockwise direction against the bias of the spring 114. Because of the elliptical-shaped opening 108 in the locking cam 102, the rotation of the cam surface 112 in the clockwise direction causes the bushing 110 to move upwardly within the opening 108. This upward movement of the bushing 110 causes cam surface 112 of the locking cam 102 to move away from the cam surface 88 of the locking sector 82. At this point, the elevating leg rest assembly 10 is in an unlocked position and the top tube member 84 of the calf clamp assembly 80 can be moved in an upward direction.

Once the top tube member 84 has been moved upwardly to a desired position, the bias of the spring 114 causes the locking cam to move in a counterclockwise direction. As a result, the bushing 110 moves downward within the opening 108, thereby causing the cam surface 112 of the locking cam 102 to move toward and frictionally engage the cam surface 88 of the locking sector 82 such that the top tube member 84 can no longer freely move in an upward or downward direction. At this point, the elevating leg rest assembly 10 is in a locked position.

The calf clamp assembly 80 of the elevating leg rest assembly 10 can be released from its locked position by using the release mechanism 100. This is accomplished by depressing the push knob 106 on the top portion of the release mechanism 100, causing the release plate 104 to move in a downward direction. This downward movement of the release plate 104 causes the locking cam 102 to rotate in the clockwise direction, thereby causing the cam surface 112 of the locking cam 102 to move away from the cam surface 88 of the locking sector 82. When the push knob 106 is released, the bias of the spring 114 causes the locking cam 102 to rotate in the counterclockwise direction, thereby causing the release plate 104 and the push know 106 to move in an upward direction. In addition, the counterclockwise movement of the locking cam 102 causes the cam surface 112 to frictionally engage the cam surface 88 of the locking sector 82 to lock the elevating leg rest assembly 10 in place.

Figure 5:
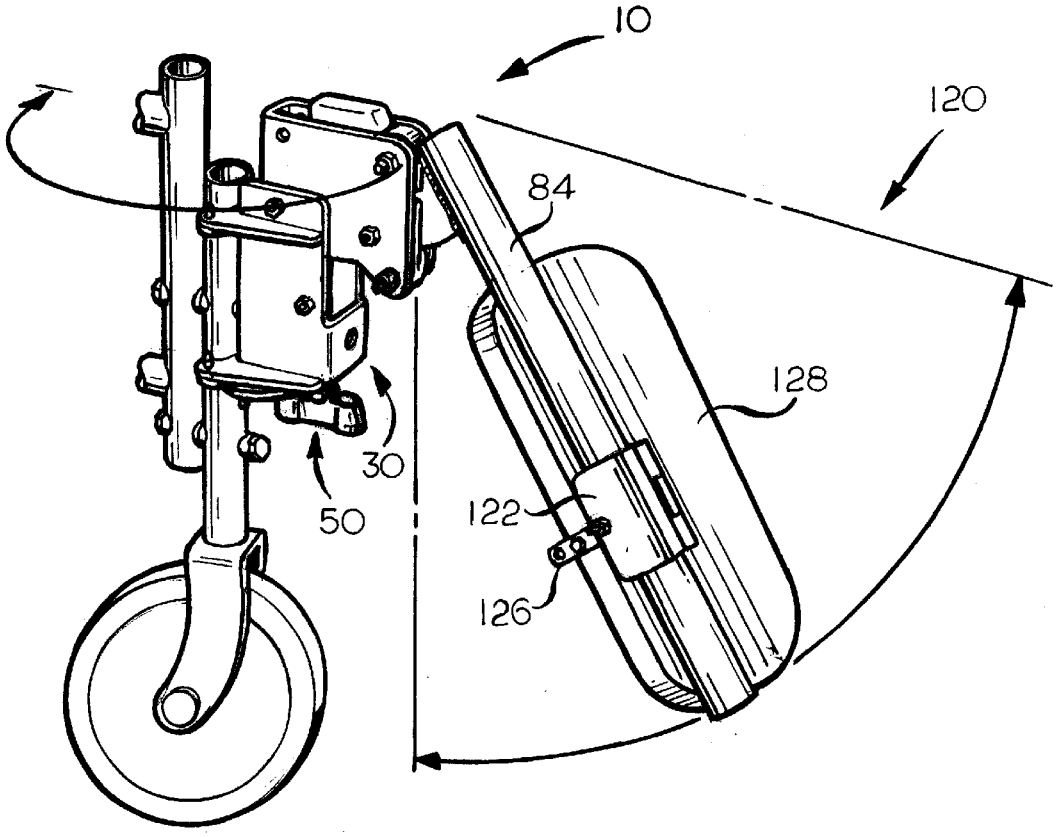
FIG. 5 is a side perspective view of the universal elevating leg rest assembly with a calf support assembly according to the preferred embodiment of the invention.
Figure 6:
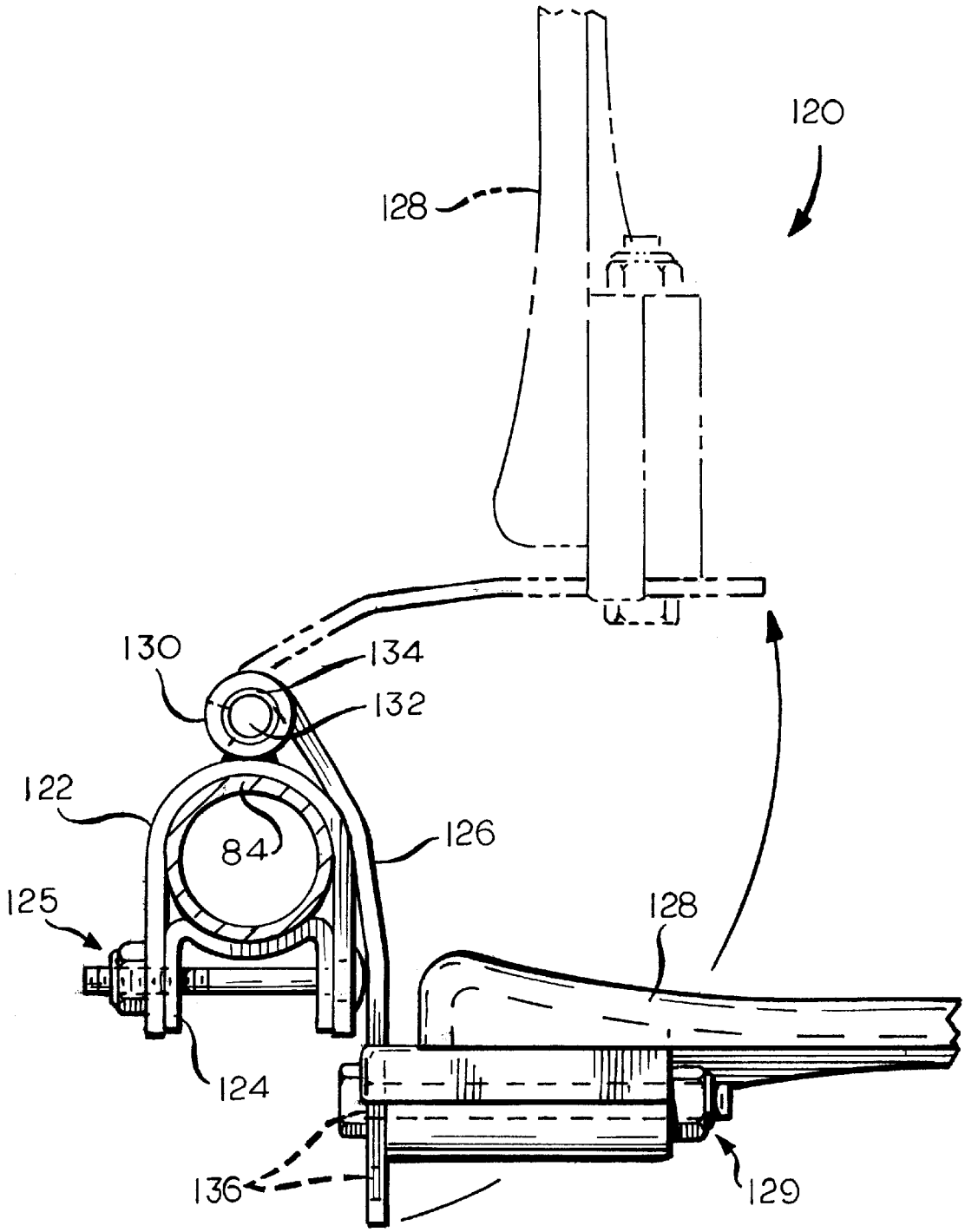
FIG. 6 is a side elevational view of the calf support assembly.
Figure 7:
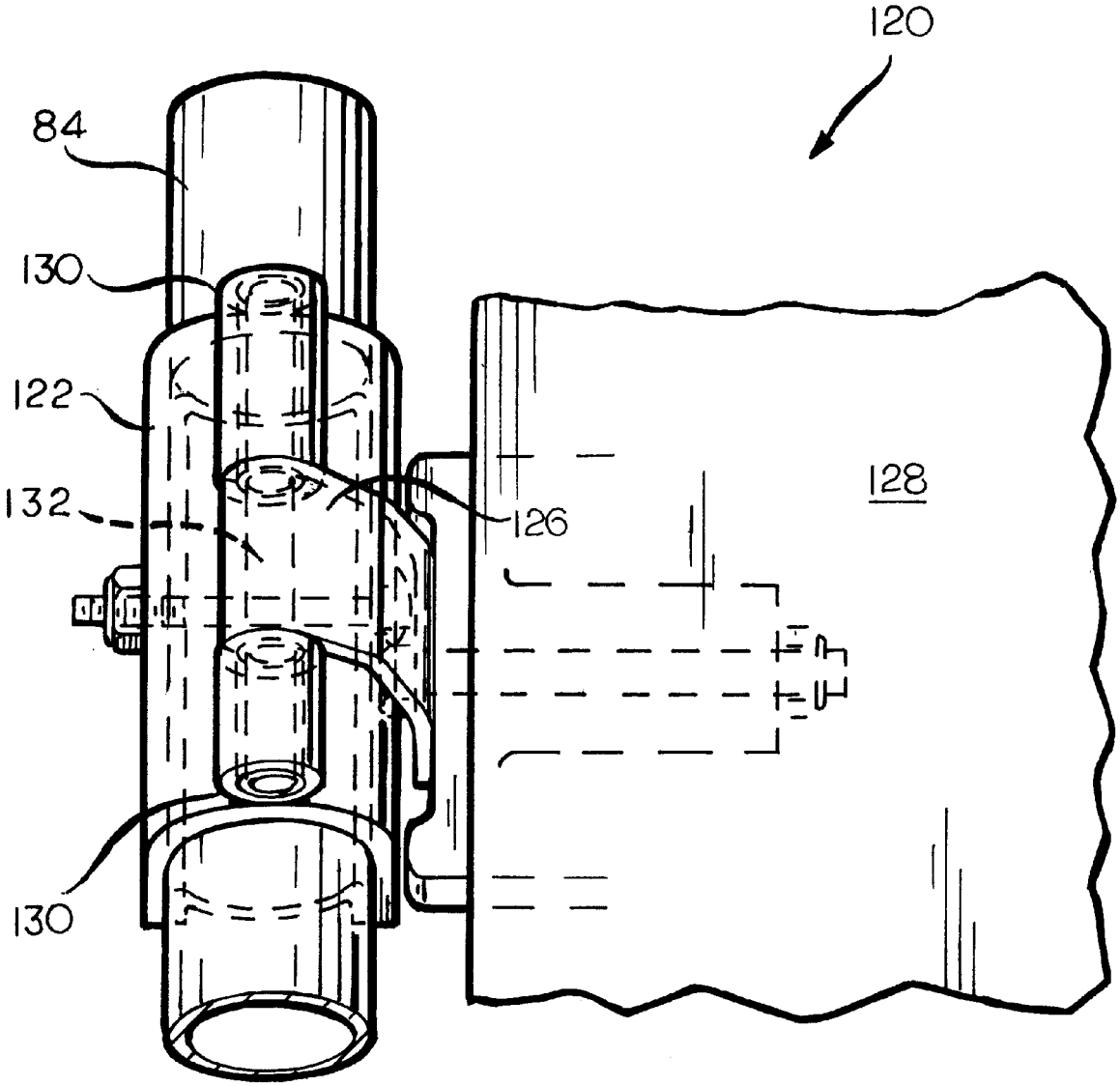
FIG. 7 is a top view of the calf support assembly.

Referring now to FIGS. 5 through 7, there is illustrated a universal elevating leg rest assembly including a calf support assembly, shown generally as 120, according to the preferred embodiment of the invention. The calf support assembly 120 includes a generally U-shaped clamp member 122 having an aperture for removably attaching the clamp member 122 to the top tube member 84 using any suitable fastening means 125, such as a threaded fastener, and the like. The clamp member 122 includes at least one sleeve 130, and preferably two sleeves, that may be integrally formed with the clamp member 122, or alternatively, may be fixedly attached to the clamp member 122 by braising, welding, and the like. A locator 124 may be used to properly position and securely fasten the clamp member 122 to the top tube member 84.

Referring now to FIGS. 6 and 7, the calf support assembly 120 also includes a bracket 126. As shown in FIGS. 6 and 6, the bracket 126 is in a horizontally-extended position. In this position, the bracket 126 is supported by the clamp member 122. One end of the bracket 126 includes a pin 132 that may be integrally formed with the bracket 126 or, alternatively, may be fixedly attached to the bracket 126 by braising, welding, and the like. The bracket 126 may be pivotally mounted to the clamp member 122 by inserting the pin 132 within the sleeves 130 of the clamp member 122. A bushing 134, made of low friction material, such as plastic, TEFLON®, and the like, may be disposed between the sleeves 130 and the pin 132 to facilitate the pivoting movement of the bracket 126 relative to the clamp member 122. A calf plate 128 can be fixedly attached to the bracket 126 using well known fastening means 129, such as a threaded fastener, and the like. The bracket 126 may include a plurality of openings 136 for allowing the user to select the vertical mounting position of the calf plate 128 (as viewed in FIG. 6). Pivotally mounting to the bracket 126 to the clamp member 122 allows the bracket 126, along with the calf plate 128, to be pivoted approximately 90 degrees to an upright, vertical position (as indicated by the arrow in FIG. 6) to allow easy packaging of the calf support assembly 120.

The universal elevating leg rest assembly 10 can be used on either the left or right side of the wheelchair, as determined by the location of the pivot pins 18, 22 on the upper and lower hanger plates 16, 20. For example, as shown in FIG. 2, when the pivot pins 18, 22 can be located on the right side of the wheelchair with respect to the occupant sitting in the wheelchair, the universal elevate leg rest assembly 10 can be used for a right leg rest by placing the pivot pins 18,

22 into the right pivot holes 40, 42. Likewise, when the pivot pins 18, 22 are located on the left side of the wheelchair with respect to the occupant sitting in the wheel chair, the universal elevating leg rest assembly 10 can be used for a left leg rest by placing the pivot pins 18, 22 into the left pivot holes 40, 42. In both instances, the universal elevating leg rest assembly 10 can then be swung into a locked position by pivoting the universal elevating leg rest assembly 10 until the latch mechanism 50 locks the universal elevating leg rest assembly 10 into a predetermined, forward position.

Referring now to FIG. 5, the latch mechanism 50 of the elevating leg rest assembly 10 is in a locked position. When the latch mechanism 50 is in an unlocked position, the universal bracket assembly 30 allows the elevating leg rest 10 to be swung in the horizontal direction, as indicated by the arrow. Once swung to the side, the elevating leg rest 10 can be easily removed from the wheelchair by lifting up on the elevating leg rest assembly 10 until the pivot pins 18, 22 arc no longer received in the pivot holes 40, 42. Likewise, the calf clamp assembly 80, in combination with the release mechanism 100, allow the elevating universal leg rest 10 to be raised or lowered in the vertical direction, as indicated by the arrow.

It should be appreciated that many variations of mounting the universal elevating leg rest assembly 10 to the wheelchair are possible. For example, the upper and lower hanger plates 16, 20 can be mounted directly to the front frame of the wheelchair, thereby eliminating the need for the frame tube member 14.

The universal elevating leg rest assembly 10 gives the occupant the ability to easily adjust the height of the calf support assembly 120 and allows the occupant to swing the elevating leg rest assembly 10 away and detach the universal elevating leg rest assembly 10, if desired. Further, the elevating leg rest assembly 10 gives the occupant the ability to mount the universal elevating leg rest assembly 10 on either side of the wheelchair without the need for the left or right "handed" parts.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An elevating leg rest assembly for use with a wheelchair which includes a seat, a front, two sides and two front corners adjacent the front and sides, comprising:

first and second hanger plates adapted to be attached to a wheelchair adjacent a front corner;

a universal bracket assembly adapted to be attached to said first and second hanger plates mounted adjacent either front corner of a wheelchair to pivot between a position in front of the wheelchair and a position to the adjacent side of a wheelchair to which said hanger plates are attached, whereby said universal bracket assembly is interchangeable for attachment adjacent either of the two front corners of a wheelchair;

a calf clamp assembly connected to said universal bracket assembly, a leg rest attached to said calf clamp assembly for pivoting relative to said universal bracket assembly over a predetermined arc relative to said universal bracket assembly, and wherein said calf assembly includes a release mechanism, said release mechanism releasably locking a pivotal position of said calf clamp assembly at a desired location on said arc relative to said universal bracket assembly, said release mechanism including a locking cam having a cam surface for frictionally engaging the cam surface of said calf clamp assembly, a release plate rotatably mounted to said calf clamp assembly, a release knob operatively connected to rotate said release plate, and a spring for biasing said locking cam and said release knob.

2. The elevating leg rest assembly according to claim 1, wherein rotating said release plate in a first direction causes said locking cam to rotate in a first direction until the cam surface of said locking cam frictionally engages the cam surface of said locking sector to lock the position of said elevating leg rest assembly.

3. The elevating leg rest assembly according to claim 2, wherein rotating said release plate in a second direction causes said locking cam to rotate in a second direction away from frictional engagement with the cam surface of said locking cam, thereby causing said elevating leg rest assembly to be in an unlocked position.

4. An elevating leg rest assembly for use with a wheelchair which includes a seat, a front, two sides and two front corners adjacent the front and sides, comprising:

first and second hanger plates adapted to be attached to a wheelchair adjacent a front corner;

a universal bracket assembly adapted to be attached to said first and second hanger plates mounted adjacent either front corner of a wheelchair to pivot between a position in front of the wheelchair and a position to the adjacent side of a wheelchair to which said hanger plates are attached, whereby said universal bracket assembly is interchangeable for attachment adjacent either of the two front corners of a wheelchair;

a calf clamp assembly connected to said universal bracket assembly, a leg rest attached to said calf clamp assembly for pivoting relative to said universal bracket assembly, a latch mechanism operably connected to said universal bracket assembly including at least one latch member having a latch seat, a first cam surface and a second cam surface, a spacer plate adjacent said at least one latch member, a release knob pivotally attached to said spacer plate, a release plate having a latch pin for cooperating with the first cam surface and a release pin for operatively connecting said release knob to said release plate.

5. The elevating leg rest assembly according to claim 1, and including means for positioning said release knob at a plurality of different orientations with respect to said release pin.

6. A universal elevating leg rest assembly for a wheelchair having a front, two sides and two front corners adjacent the front and sides, comprising:

an upper hanger plate and a lower hanger plate adapted to be attached to a wheelchair adjacent a front corner, said lower hanger plate including a pair of latch pins a universal bracket assembly adapted to be attached to upper and lower hanger plates mounted adjacent either front corner of a wheelchair to pivot between a position in front of the wheelchair and a position towards the adjacent side of a wheelchair to which said upper and lower hanger plates are attached whereby said universal bracket assembly is interchangeable for attachment adjacent either of the two front corners of a wheelchair, said universal bracket assembly including an upper mounting plate and a lower mounting plate, each mounting plate including a pair of pivot holes for pivotally mounting said universal bracket assembly to said hanger plates for rotation about a generally vertical axis;

said universal bracket assembly including a latch mechanism adapted to releasably engage said latch pins whereby said bracket assembly is prevented from rotating relative to said lower hanger plate when said latch mechanism engages said latch pins and said universal bracket assembly can rotate on said hanger plates towards an adjacent side of a wheelchair when said latch mechanism is released;

a calf clamp assembly pivotally connected to said universal bracket assembly and including a locking sector having a cam surface;

a release mechanism including a locking cam having a cam surface movable between a locked position wherein the cam surface of said locking cam frictionally engages the cam surface of said locking sector and an unlocked position wherein the cam surface of said locking cam does not frictionally engage the cam surface of said locking sector; and a leg rest attached to said calf clamp assembly for pivoting relative to said universal bracket assembly.

7. The elevating leg rest assembly according to claim 6, wherein said release mechanism further includes a release plate rotatably mounted to said calf clamp assembly, a release knob operatively connected to said release plate, and a spring biasing said locking cam and said release knob.

8. The elevating leg rest assembly according to claim 7, and including means for positioning said release knob at a plurality of different orientations with respect to said release plate.

9. The elevating leg rest assembly according to claim 7, wherein rotating said release plate in a first direction causes said locking cam to rotate in the first direction into frictional engagement with the cam surface of said locking sector.

10. The elevating leg rest assembly according to claim 9, wherein rotating said release plate in a second direction causes said locking cam to rotate in the second direction away from frictional engagement with the cam surface of said locking sector.

11. The elevating leg rest assembly according to claim 6, further including a calf support assembly removably attached to said calf clamp assembly.

* * * * *